US010974541B2

(12) United States Patent
Rogers et al.

(10) Patent No.: US 10,974,541 B2
(45) Date of Patent: Apr. 13, 2021

(54) DRY ERASER AND ASSOCIATED SYSTEMS AND METHODS

(71) Applicant: Walmart Apollo, LLC, Bentonville, AR (US)

(72) Inventors: Sheila Kay Rogers, Bella Vista, AR (US); Crystal Lynn Lewis, Bentonville, AR (US); Steven Jackson Lewis, Bentonville, AR (US); Sosha Kay Morris, Bella Vista, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 76 days.

(21) Appl. No.: 15/690,531

(22) Filed: Aug. 30, 2017

(65) Prior Publication Data

US 2018/0056708 A1 Mar. 1, 2018

Related U.S. Application Data

(60) Provisional application No. 62/381,328, filed on Aug. 30, 2016.

(51) Int. Cl.
*B43L 19/00* (2006.01)

(52) U.S. Cl.
CPC ..... *B43L 19/0018* (2013.01); *B43L 19/0056* (2013.01)

(58) Field of Classification Search
CPC .. B43L 21/04; B43L 19/0018; B43L 19/0056; B65D 83/0805; A47K 2010/3266; A47K 10/32
USPC ..... 15/209.1, 223, 224, 231; 221/56, 87, 29, 221/91, 36–37, 40, 45; 206/266
See application file for complete search history.

(56) References Cited

U.S. PATENT DOCUMENTS

| | | | | |
|---|---|---|---|---|
| 873,550 A | | 12/1907 | Hudson | |
| 2,127,794 A | | 8/1938 | Gothard | |
| 2,490,440 A | | 12/1949 | Hyman | |
| 2,828,500 A | | 4/1958 | Peacock | |
| 2,859,463 A | | 11/1958 | Hirsch | |
| 2,972,768 A | | 2/1961 | Petion | |
| 3,031,711 A | | 5/1962 | Herman | |
| 3,110,917 A | * | 11/1963 | McPeek, Jr. | B43L 21/00 15/118 |
| 3,118,166 A | | 1/1964 | Bell | |

(Continued)

FOREIGN PATENT DOCUMENTS

JP H1118987 A * 1/1999 ..... A47K 7/00

OTHER PUBLICATIONS

Translation of JPH1118987, Espacenet, Dec. 31, 2018 (Year: 2018).*

*Primary Examiner* — Laura C Guidotti
*Assistant Examiner* — Thomas Raymond Rodgers
(74) *Attorney, Agent, or Firm* — Fitch, Even, Tabin & Flannery LLP

(57) ABSTRACT

An example dry eraser and associated systems and methods are described. The example dry eraser includes a body with a top wall, a bottom wall, a front wall, a rear wall, and first and second side walls. The body includes a hollow interior configured and dimensioned to receive therein a plurality of individual wipes. The top wall of the body includes an opening configured and dimensioned to dispense therefrom the plurality of individual wipes. The dry eraser includes an erasure material disposed on at least a portion of the bottom wall of the body.

13 Claims, 7 Drawing Sheets

(56) References Cited

U.S. PATENT DOCUMENTS 3,135,990 A 6/1964 Bergmann
3,328,830 A 7/1967 Corwin
3,397,818 A * 8/1968 Rey ..... B65D 83/0829 206/39.4
3,444,579 A * 5/1969 Thomford ..... B43L 21/00 15/118
3,603,692 A 9/1971 Ball et al.
3,704,072 A 11/1972 Kaufman
3,713,744 A 1/1973 Sims
3,837,747 A 9/1974 Seymore
D236,072 S 7/1975 Tsang
4,183,684 A 1/1980 Avery, Jr.
4,415,288 A 11/1983 Gordon et al.
4,481,126 A 11/1984 Trinh et al.
4,543,680 A 10/1985 Vlahos
4,693,840 A 9/1987 Trinh et al.
D294,989 S 3/1988 Jinkins
4,776,716 A 10/1988 Huang
4,873,728 A * 10/1989 Bono ..... A47K 13/302 4/233
4,903,365 A 2/1990 Kaufman
4,925,327 A 5/1990 Wirt
4,955,747 A 9/1990 Tarver
D318,158 S 7/1991 Ediger et al.
5,267,369 A 12/1993 O'Neil et al.
5,362,165 A 11/1994 Kluga et al.
5,540,354 A * 7/1996 Annand ..... A47K 10/423 206/449
5,595,223 A 1/1997 Hayao
5,704,471 A * 1/1998 Yamada ..... B65D 75/58 206/207
6,250,831 B1 6/2001 Craven
6,321,941 B1 11/2001 Argentieri et al.
6,639,185 B1 * 10/2003 McConnell ..... A47K 10/421 219/386
6,742,951 B2 6/2004 Schultz et al.
6,960,349 B2 * 11/2005 Shantz ..... A61K 8/0208 424/402
7,195,677 B2 * 3/2007 Morrisey-Hawkins ..... A47K 10/3827 134/6
7,261,701 B2 8/2007 Davis et al.
7,264,414 B2 9/2007 McReynolds et al.
7,309,181 B2 12/2007 Hawkins
7,470,078 B2 12/2008 Banco et al.
7,549,815 B2 6/2009 Wong
7,572,079 B2 8/2009 Wong
7,731,056 B2 * 6/2010 Tramontina ..... A61B 42/40 221/254
7,967,520 B2 6/2011 Hawkins
8,044,325 B1 * 10/2011 Cooper ..... A47K 10/32 219/386
8,186,897 B2 5/2012 Kaufman et al.
8,348,913 B2 1/2013 Hoang et al.
8,556,529 B2 10/2013 Law et al.
8,684,619 B2 4/2014 Uchiyama et al.
8,834,055 B2 9/2014 Uchiyama et al.
9,016,967 B2 4/2015 Law et al.
9,498,094 B2 * 11/2016 Van Diepen ..... A47K 10/422
10,136,789 B2 11/2018 Lohar et al.
10,405,643 B2 9/2019 Wu
2002/0030045 A1 * 3/2002 Nakamura ..... A47K 10/422 219/386
2004/0205919 A1 * 10/2004 Sims ..... A47L 13/16 15/209.1
2005/0260028 A1 11/2005 Gu
2006/0000043 A1 * 1/2006 Jou-Chen ..... A47L 13/16 15/231
2006/0249524 A1 * 11/2006 Headrick ..... A47K 10/426 221/45
2007/0193597 A1 8/2007 Hurwitz
2008/0142535 A1 * 6/2008 Adler ..... B65D 83/0817 221/36
2008/0217354 A1 * 9/2008 Newman ..... B65D 83/0829 221/229
2008/0289993 A1 * 11/2008 Flannery ..... A47K 5/12 206/581
2010/0067972 A1 3/2010 Ashworth et al.
2011/0011767 A1 * 1/2011 Gehring ..... B65D 83/0811 206/581
2011/0011879 A1 * 1/2011 Johnson ..... A47K 10/422 221/45
2011/0052307 A1 3/2011 Weng
2011/0240514 A1 * 10/2011 Bandoh ..... B65D 25/22 206/555
2013/0047358 A1 2/2013 Shafer et al.
2016/0144654 A1 5/2016 Green et al.
2018/0056709 A1 3/2018 Rogers et al.
2018/0056710 A1 3/2018 Boettcher et al.
2019/0118573 A1 4/2019 Nelson, Jr. et al.

* cited by examiner

DRY ERASER AND ASSOCIATED SYSTEMS AND METHODS

CROSS-REFERENCE TO RELATED PATENT APPLICATIONS

This application claims priority to U.S. Provisional Application No. 62/381,328 filed on Aug. 30, 2016, the content of which is hereby incorporated by reference in its entirety.

BACKGROUND

Whiteboards are used in a variety of settings, such as schools and businesses, for teaching or brainstorming sessions. Dry-erase markers are generally used to write on the whiteboard, and dry erasers including a non-abrasive surface are used to remove the writing from the whiteboard. Using the dry eraser on its own to remove the writing on the whiteboard can leave remnants of the dry-erase marker on the whiteboard, and writing on a whiteboard for an extended period of time can result in difficulty in removing all of the dry-erase marker writing.

SUMMARY

Exemplary embodiments of the present disclosure provide a dry eraser that includes an internal chamber with a plurality of individual wipes for cleaning a whiteboard. In particular, the dry eraser includes a non-abrasive erasure material on one side of the body, and further includes a hollow interior with a plurality of individual wipes that can be dispensed for cleaning the whiteboard. Each of the wipes can be presoaked in a cleaning fluid. Thus, rather than locating paper towels and a cleaning fluid for cleaning the whiteboard, the user can dispense individual cleaning wipes directly from the dry eraser, simplifying the overall process for the user.

In accordance with embodiments of the present disclosure, an exemplary dry eraser is provided. The dry eraser includes a body including a top wall, a bottom wall, a front wall, a rear wall, and first and second side walls. The body includes a hollow interior configured and dimensioned to receive therein a plurality of individual wipes. The top wall of the body includes an opening configured and dimensioned to dispense therefrom the plurality of individual wipes. The dry eraser includes an erasure material disposed on at least a portion of the bottom wall of the body.

In some embodiments, the erasure material can be felt. In some embodiments, the dryer eraser can include a magnetic component mounted to the outside of the body or incorporated within the body. In some embodiment, the opening of the top wall of the body can be configured and dimensioned to receive therethrough a container including the plurality of individual wipes. The dry eraser can include a lid hingedly mounted to the top wall of the body and configured to be positioned in a closed position and an open position. The lid covers the opening in the top wall in the closed position to prevent the individual wipes from drying out.

In some embodiments, the first side wall, the second side wall, the front wall or the rear wall can include an elongated opening extending into the hollow interior of the body. The elongated opening can be configured and dimensioned for introduction of the plurality of individual wipes therethrough and into the hollow interior of the body. In such embodiments, the dry eraser can include a latch configured to be positioned in a closed position and an open position, the latch covering the elongated opening in the closed position. The dry eraser can include a spring-loaded platform disposed on an inner surface of the hollow interior. The spring-loaded platform biases the plurality of individual wipes in the direction of the opening in the top wall.

In some embodiments, at least one of the front wall, the rear wall, the first side wall, or the second side wall can include a transparent window for visualizing a fullness level of the hollow interior with the plurality of individual wipes. In some embodiments, at least one of the front wall, the rear wall, the first side wall, or the second side wall can include a moisture sensor indicating a moisture level of the plurality of individual wipes within the hollow interior. The moisture level is indicated in a color-coded manner, each color indicating a different moisture level.

In some embodiments, the dry eraser can include a dispensing mechanism for dispending the plurality of individual wipes through the opening. The dispensing mechanism can include a door slidably disposed relative to the opening of the top wall and configured to be positioned in a closed position or an open position. The door covers the opening of the top wall in the closed position. The dispensing mechanism further includes an actuator (e.g., a button) configured to be depressed or slid relative to the body to position the door between the closed and open positions.

The dispending mechanism includes an extension disposed within the hollow interior and mechanically cooperating with the actuator such that depressing or sliding the actuator simultaneously or substantially simultaneously positions the door in the open position, actuates the extension to hook onto one of the plurality of individual wipes, and at least partially dispenses one of the plurality of individual wipes from the opening in the top wall without dispensing a subsequent individual wipe. The actuator can be spring-loaded such that releasing the depressed or slid actuator repositions the extension within the hollow interior and positions the door in the closed position.

In accordance with embodiments of the present disclosure, an exemplary dry eraser system is provided. The dry eraser system includes a plurality of individual wipes and a dry eraser. The dry eraser includes a body with a top wall, a bottom wall, a front wall, a rear wall, and first and second side walls. The body includes a hollow interior configured and dimensioned to receive therein the plurality of individual wipes. The top wall of the body includes an opening configured and dimensioned to dispense therefrom the plurality of individual wipes. The dry eraser includes an erasure material disposed on at least a portion of the bottom wall of the body.

In accordance with embodiments of the present disclosure, an exemplary method of dispensing individual wipes is provided. The method includes providing a dry eraser as disclosed herein. The method includes positioning the plurality of individual wipes within the hollow interior of the body of the dry eraser. The method further includes dispensing the plurality of individual wipes from the dry eraser through the opening in the top wall of the body of the dry eraser.

In some embodiments, the dry eraser includes a lid hingedly mounted to the top wall of the body and configured to be positioned in a closed position and an open position. The lid can cover the opening in the top wall in the closed position. In such embodiments, the method includes positioning the lid in the open position prior to dispensing the plurality of individual wipes from the dry eraser through the opening.

In some embodiments, the first side wall, the second side wall, the front wall or the rear wall includes an elongated opening extending into the hollow interior of the body. In such embodiments, positioning the plurality of individual wipes within the hollow interior of the body of the dry eraser includes introducing the plurality of individual wipes through the elongated opening and into the hollow interior of the body.

In some embodiments, dispensing the plurality of individual wipes from the dry eraser through the opening can include depressing or sliding an actuator of a dispensing mechanism of the dry eraser to position a door slidably disposed relative to the opening of the top wall in an open position, actuate an extension of the dispensing mechanism to hook onto one of the plurality of individual wipes, and at least partially dispense one of the plurality of individual wipes from the opening in the top wall without dispensing a subsequent individual wipe.

Any combination and/or permutation of embodiments is envisioned. Other objects and features will become apparent from the following detailed description considered in conjunction with the accompanying drawings. It is to be understood, however, that the drawings are designed as an illustration only and not as a definition of the limits of the present disclosure.

BRIEF DESCRIPTION OF THE DRAWINGS

To assist those of skill in the art in making and using the disclosed dry erasers and associated systems and methods, reference is made to the accompanying figures, wherein.

DETAILED DESCRIPTION

Figure 1:
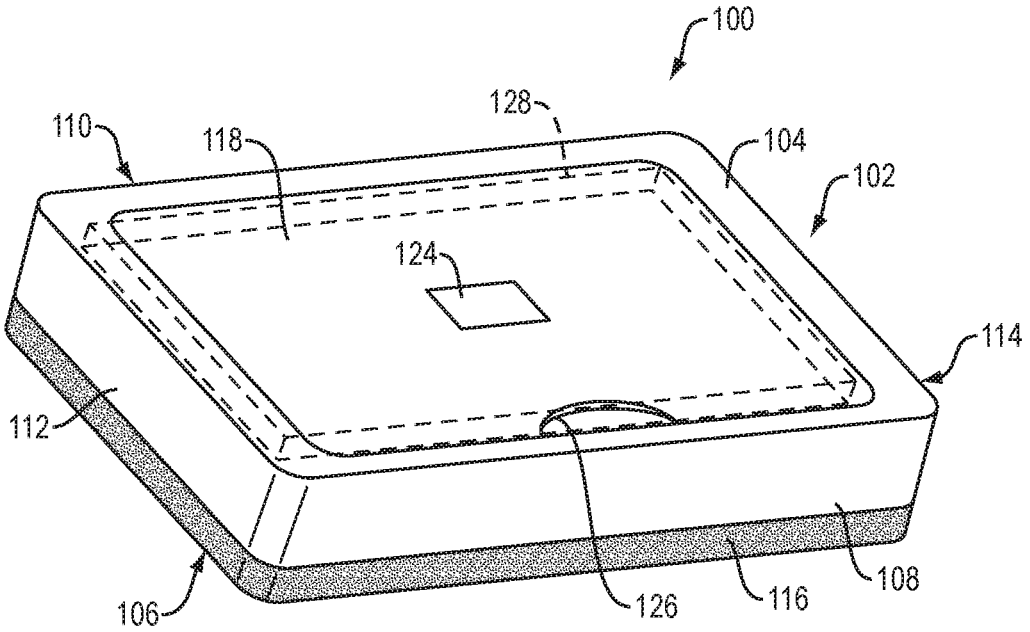
FIG. 1 is a perspective view of an exemplary dry eraser of the present disclosure.
Figure 2:
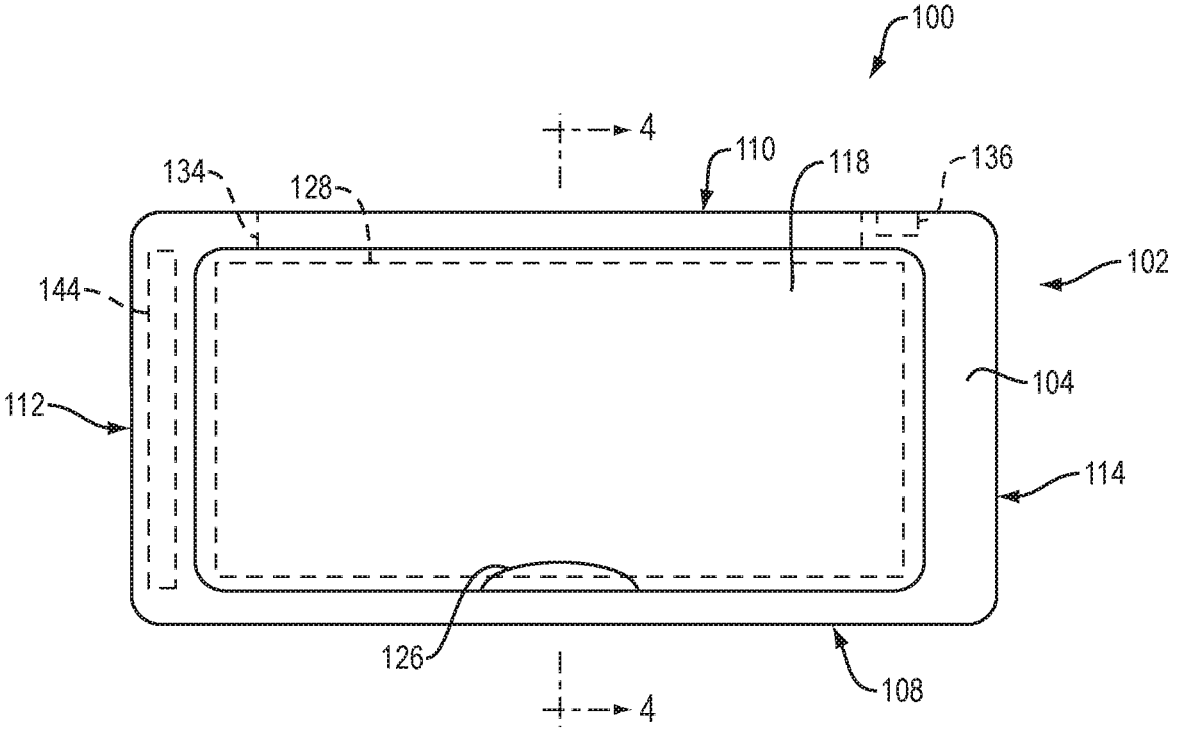
FIG. 2 is top view of an exemplary dry eraser of the present disclosure.
Figure 3:
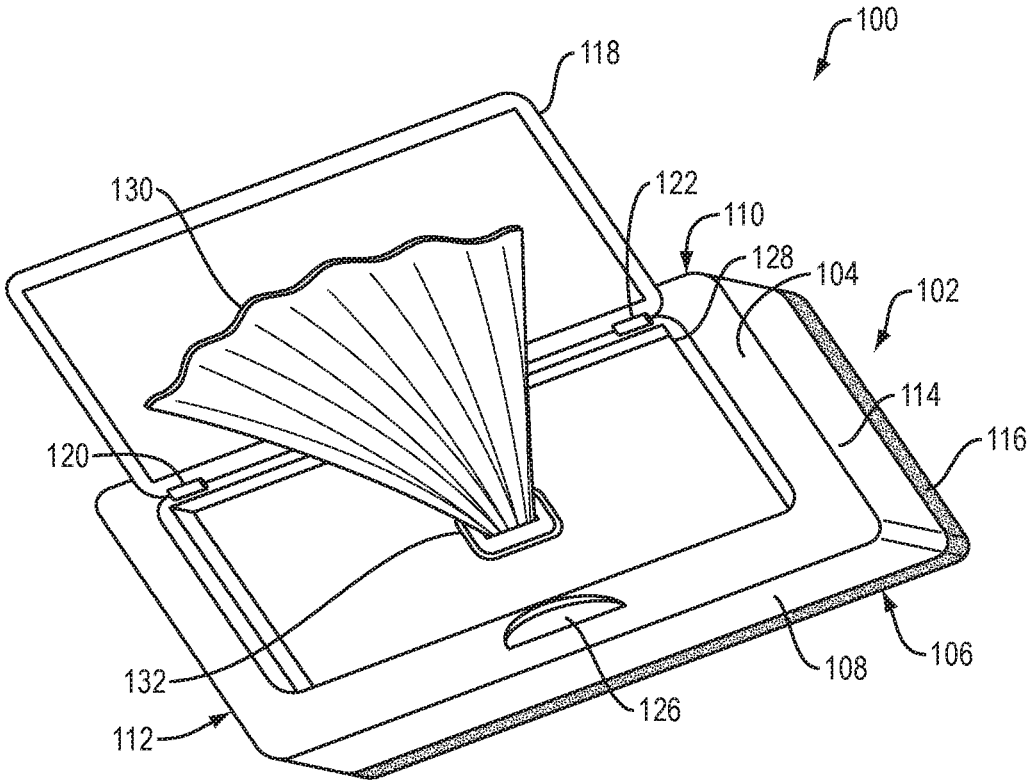
FIG. 3 is a perspective view of an exemplary dry eraser of the present disclosure including an open lid.

It should be understood that the relative terminology used herein, such as "front", "rear", "left", "top", "bottom", "vertical", "horizontal", "up" and "down" is solely for the purposes of clarity and designation and is not intended to limit embodiments to a particular position and/or orientation. Accordingly, such relative terminology should not be construed to limit the scope of the present disclosure. In addition, it should be understood that the scope of the present disclosure is not limited to embodiments having specific dimensions. Thus, any dimensions provided herein are merely for an exemplary purpose and are not intended to limit the invention to embodiments having particular dimensions.

Exemplary embodiments of the present disclosure provide a dry eraser that includes an internal chamber configured to hold and individually dispense a plurality of individual wipes for cleaning a whiteboard. In particular, the dry eraser includes a non-abrasive erasure material on one side of the body, and further includes a hollow interior with a plurality of individual wipes that can be dispensed for cleaning the whiteboard. In some embodiments, separately and individually stored in the dry eraser and the dry eraser can include a dispensing mechanism configured to dispense one wipe at a time without dispensing a subsequent wipe or preparing a sequent wipe for dispensing. Each of the wipes can be presoaked in a cleaning fluid. Thus, rather than locating paper towels and a cleaning fluid for cleaning the whiteboard, the user can dispense individual cleaning wipes directly from the dry eraser, simplifying the overall process for the user.

FIGS. 1-4 show perspective, top and cross-sectional views of an exemplary dry eraser 100 of the present disclosure. The dry eraser 100 generally includes a body 102 with a top wall 104, a bottom wall 106, a front wall 108, a rear wall 110, a first side wall 112, and a second side wall 114. The bottom wall 106 includes an erasure material 116 attached thereto and covering at least a portion of the bottom wall 106. The erasure material 116 can be fabricated from a non-abrasive material, such as felt, and can be used to wipe the surface of a whiteboard.

The dry eraser 100 includes a lid 118 hingedly connected to the top wall 104 of the body 102. For example, hinges 120, 122 can rotatably connect the lid 118 to the rear wall 110 of the body 102. Thus, the lid 118 can be rotated between a closed position (e.g., shown in FIGS. 1, 2 and 4) and an open position (e.g., shown in FIG. 3). In the open position, the lid 118 exposes an interior of the dry eraser 100. In some embodiments, the top surface of the lid 118 can include an actuator 124 (e.g., a button) that can be depressed to disengage a locking mechanism associated with the lid 118, thereby opening the lid 118 from the top wall 104 of the body 102. In some embodiments, an edge of the top surface of the lid 118 can include a cutout 126 (e.g., a semicircular cutout) formed therein. The cutout 126 can be used to flip open the lid 118 from the top wall 104 of the body 102. In some embodiments, the cutout 126 can be formed in the top wall 104 adjacent to an edge of the lid 118. The top surface of the lid 118 can include one or more graphics, skins or logos, e.g., CASEMATE™.

The body 102 includes a hollow interior 128 forming a chamber configured and dimensioned to receive therein a plurality of individual wipes 130 that can be dispensed from the body 102 for cleaning the whiteboard. In some embodiments, the body 102 can be fabricated from two body halves 102*a*, 102*b* that can be disengaged to expose the hollow interior 128 for placement of individual wipes 130 or a container including the individual wipes 130 within the hollow interior 128 (e.g., FIG. 4). In such embodiments, after placement of the wipes 130 within the hollow interior 128, the two body halves 102*a*, 102*b* can be engaged or interlocked to maintain the wipes 130 within the hollow interior 128.

In some embodiments, the top wall 104 of the body 102 includes an opening dimensioned equivalent to the dimensions of the hollow interior 128 such that the wipes 130 or a container with the wipes 130 can be positioned directly into the hollow interior 128 through the opening. As will be discussed below with respect to FIG. 5, in some embodiments, one of the front wall 108, rear wall 110, first side wall 112 or second side wall 114 can include an elongated opening extending into the hollow interior 128 such that wipes 130 or a container with the wipes 130 can be inserted into the hollow interior 128 through the elongated opening.

In some embodiments, the top wall 104 includes an opening 132 formed therein. For example, the opening 132 can be disposed at a central location of the top wall 104. The opening 132 can be connected with the hollow interior 128 such that individual wipes 130 can be dispensed from the hollow interior 128 through the opening 132. Thus, the lid 118 can be rotated into the open position to expose the opening 132, the desired wipes 130 can be dispensed from the opening 132, and the lid 118 can be rotated into the closed position to cover the opening 132. In the closed position, the lid 118 assists in reducing or preventing drying of the wipes 130 stored within the hollow interior 128. In some embodiments, if the cleaning fluid in which the wipes 130 are soaked dries, additional cleaning fluid can be poured into the hollow interior 128 through the opening 132.

In some embodiments, the front wall 108, the rear wall 110, the first side wall 112 and/or the second side wall 114 can include a window 134 fabricated from a transparent (or substantially transparent) material. The window 134 provides a direct view of the contents of the hollow interior 128 such that a user can visualize the fullness level of the hollow interior 128 with the wipes 130. In some embodiments, the front wall 108, the rear wall 110, the first side wall 112 and/or the second side wall 114 can include a moisture sensor 136 configured to indicate the moisture level of the wipes 130 disposed within the hollow interior 128. In particular, the moisture sensor 136 can detect the level of moisture due to the cleaning fluid in which each of the wipes 130 is soaked, and includes an indicator for providing a visual display regarding the detected moisture level. In some embodiments, the moisture level can be indicated in a color-coded manner, with each color indicating a different moisture level (e.g., blue indicating a high level of moisture, white indicating a low level of moisture, or the like).

Figure 4:
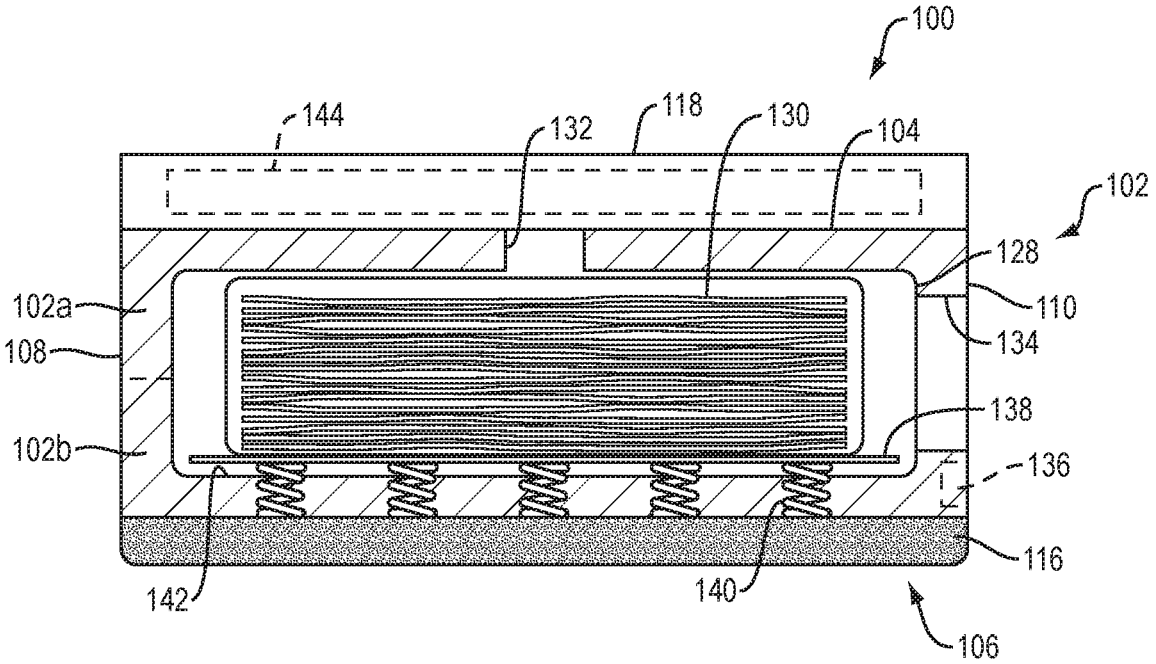
FIG. 4 is a cross-sectional view of an exemplary dry eraser of the present disclosure taken along section line 4-4 of FIG. 2.

In some embodiments, as shown in FIG. 4, the hollow interior 128 can include a spring-loaded platform 138 biased by a plurality of springs 140 in the direction of the top wall 104 of the body 102. In particular, the springs 140 can be secured to a bottom inner surface 142 of the hollow interior 128 at one end, and secured to one side of the platform 138 on the opposing end. The wipes 130 can be positioned on the platform 138 and the springs 140 bias the platform 138 and the wipes 130 positioned thereon in an upward direction towards the opening 132. Thus, as wipes 130 are dispensed from the body 102, the platform 138 is automatically biased upward to maintain the remaining wipes 130 within the hollow interior 128 directly below or adjacent to an inner surface of the top wall 104 of the body 102.

In some embodiments, one or more areas of the dry eraser 100 can include a magnetic component 144 mounted thereon or incorporated therein. For example, one or more walls of the body 102 can include the magnetic component 144 and/or the lid 118 can include the magnetic component 144. The dry eraser 100 can thereby be magnetically attached to any metal surface for convenient storage purposes.

Figure 5:
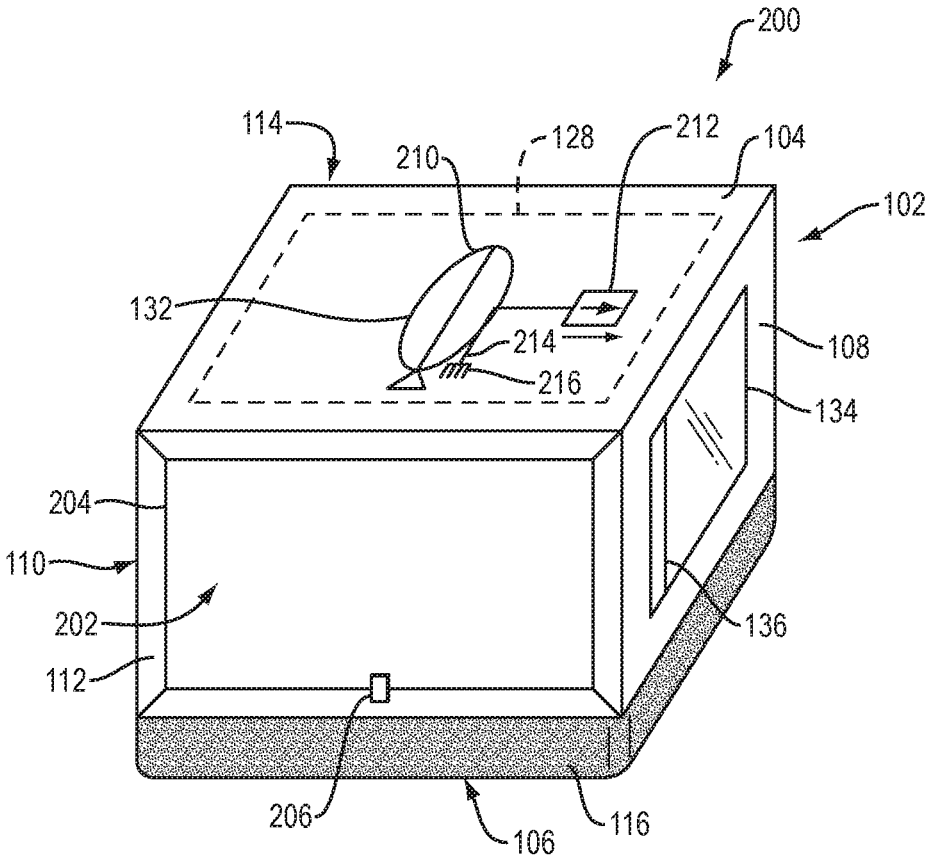
FIG. 5 is a perspective, side view of an exemplary dry eraser of the present disclosure including a dispensing mechanism.
Figure 6:
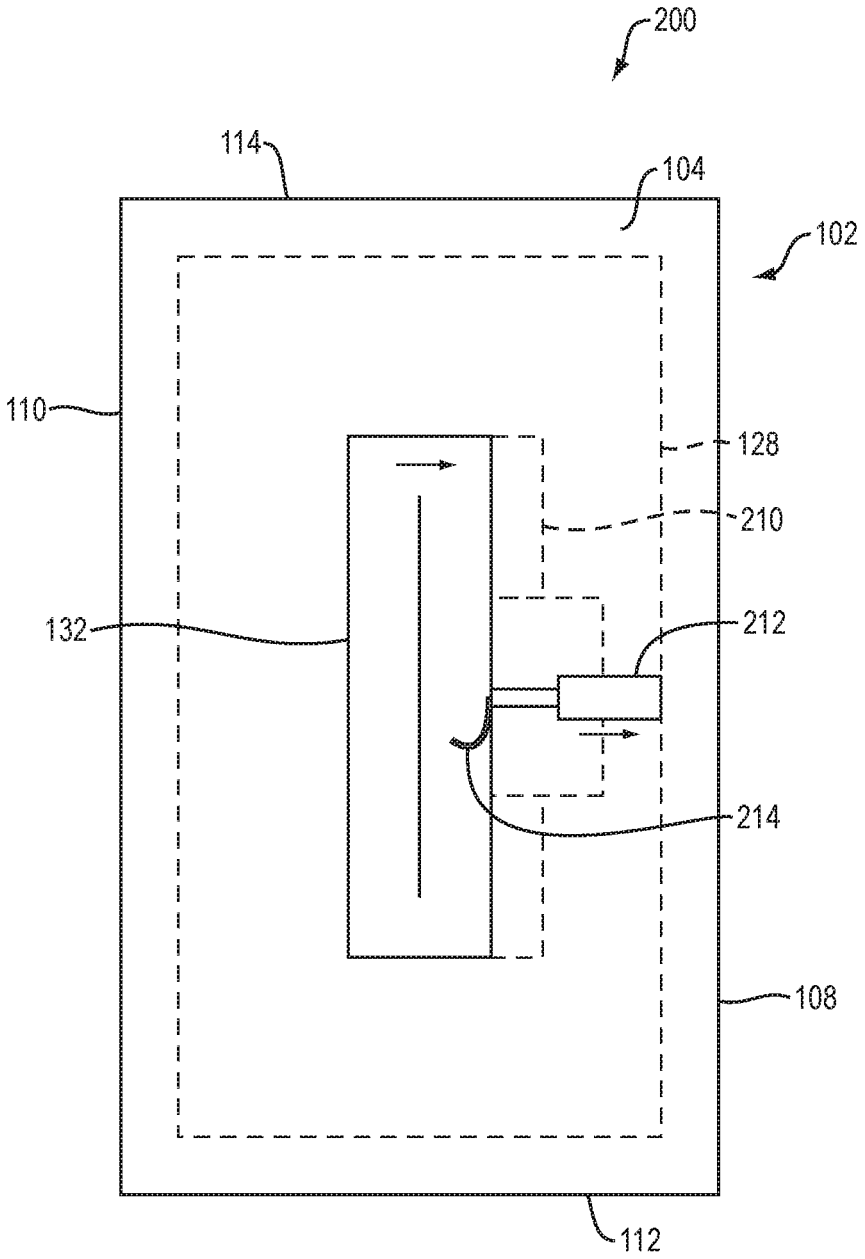
FIG. 6 is a top view of an exemplary dry eraser of the present disclosure including a dispensing mechanism.

FIGS. 5 and 6 show perspective and top views of an exemplary dry eraser 200 of the present disclosure. The dry eraser 200 can be substantially similar in structure and function to the dry eraser 100, except for the distinctions noted herein. Therefore, like references numbers represent like structures. As noted above, the dry eraser 200 can include an elongated opening 202 formed in the front wall 108, the rear wall 110, the first side wall 112, or the second side wall 114. The elongated opening 202 extends into the hollow interior 128 such that wipes 130 or a container including the wipes 130 can be inserted into the hollow interior 128 through the elongated opening 202.

The dry eraser 200 can include a door 204 hingedly connected to, e.g., the first side wall 112, such that the door 204 can be opened to expose the elongated opening 202. In some embodiments, the hollow interior 128 can include one or more puncture mechanisms such that introducing the container with the wipes 130 into the hollow interior 128 automatically punctures an end of the container to open the container for dispensing of the wipes 130. After the wipes 130 have been introduced into the hollow interior 128 through the elongated opening 202, the door 204 can be positioned in a closed position and a latch or locking mechanism 206 can be used to engage the door 204 with the first side wall 112.

In some embodiments, the wipes 130 can be folded relative to each other such that dispensing one wipe 130 guides a subsequent wipe 130 partially out of the opening 132 for easy access by the user. In some embodiments, rather than including a lid 118, the dry eraser 200 includes a top wall 104 with a dispensing mechanism 208 configured to individually dispense the wipes 130 within the hollow interior 128. In particular, the top wall 104 includes the opening 132 formed therein, and the dispensing mechanism 208 includes a door 210 slidably disposed relative to the opening 132 such that the door 210 can be slid between an open position and a closed position. In the open position, the door 210 exposes the opening 132 and the passage into the hollow interior 128. In the closed position, the door 210 covers the opening 132 and the passage into the hollow interior 128.

The dispensing mechanism 208 includes an actuator 212 (e.g., a button) on the top wall 104 configured to be depressed or slid relative to the body 102 to position the door 210 in the open position or the closed position. Thus, although illustrated as a sliding actuator 212, in some embodiments, the actuator 212 can be depressible. The dispensing mechanism 208 further includes a wipe grasping mechanism in the form of an extension 214 disposed within the hollow interior 128 and mechanically cooperating with the actuator 212.

The extension 214 can include a grasping end 216 configured and dimensioned to hook onto a single wipe 130 for dispensing the wipe 130 from the opening 132. In particular, depressing or sliding the actuator 212 simultaneously (or substantially simultaneously) positions the door 210 in the open position, actuates the extension 214 to hook onto one of the wipes 130 with the grasping end 216, and at least partially dispenses the wipe 130 from the opening 132 without dispensing a subsequent wipe 130. In some embodiments, the grasping end 216 can, e.g., including one or more hook shapes, include a VELCRO™ strip, or the like.

The actuator 212 can be spring-loaded such that releasing the depressed or slid actuator 212 repositions the extension 214 within the hollow interior 128 and positions the door 210 in the closed position. In some embodiments, the door 210 can remain in at least a partially open position while the wipe 130 is being removed through the opening 132, and as soon as the wipe 130 is fully removed from the opening 132 the spring-loaded door 210 is repositioned in a closed position. Thus, individual wipes 130 can be dispensed from the hollow interior 128 and the spring-loaded door 210 is maintained in a normally closed position to prevent the wipes 130 from drying out.

Figure 7:
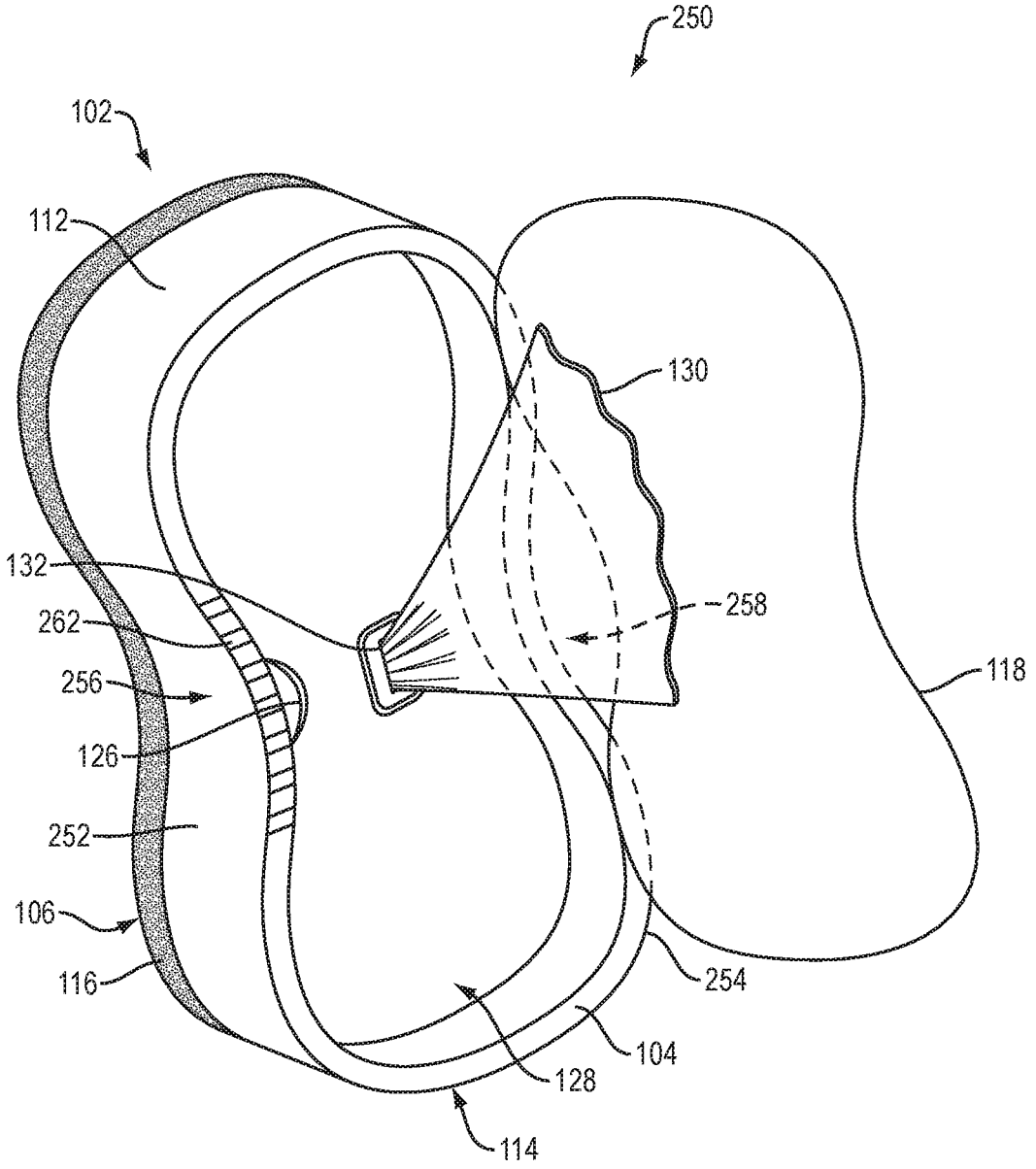
FIG. 7 is a perspective view of an exemplary dry eraser of the present disclosure including an ergonomic configuration.
Figure 8:
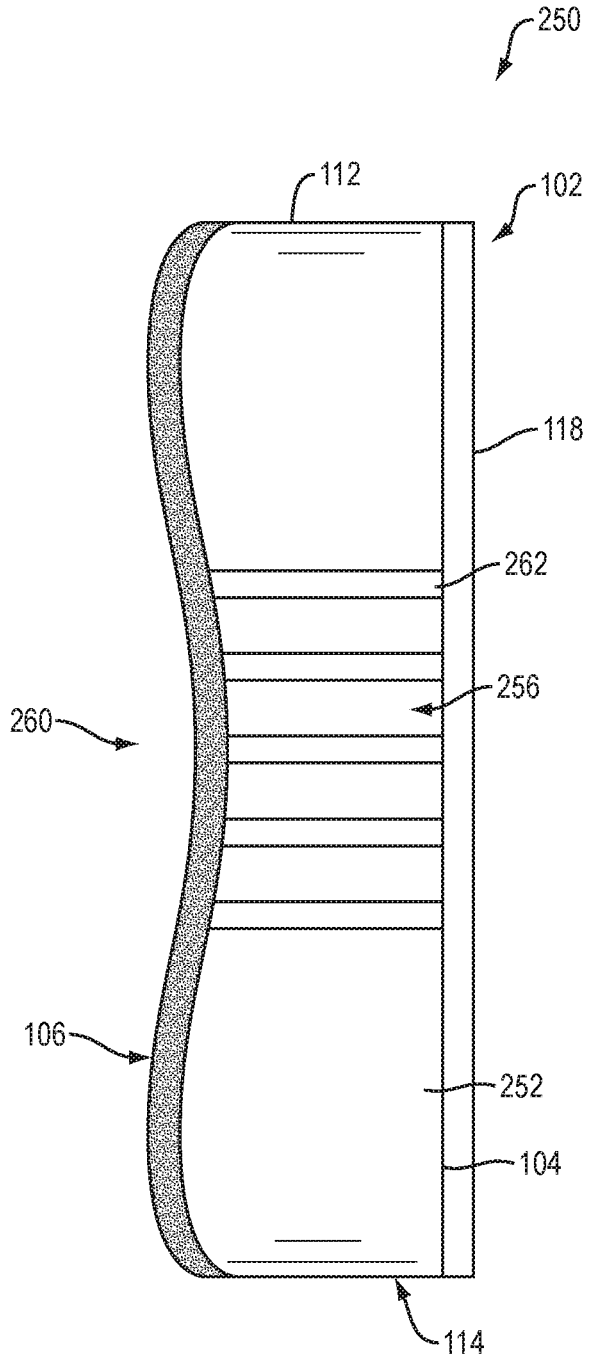
FIG. 8 is a side view of an exemplary dry eraser of the present disclosure including an ergonomic configuration.

FIGS. 7-8 show perspective and side views of an exemplary dry eraser 250 of the present disclosure. The dry eraser 250 can be substantially similar in structure and function to the dry eraser 100, 200, except for the distinctions noted herein. Therefore, like reference numbers represent like structures. In particular, rather than including substantially linear front and rear walls 108, 110, the front and rear walls 252, 254 of the dry eraser 250 can be ergonomically shaped for a better or more comfortable fit in the hand of a user. For example, the front and rear walls 252, 254 can include concave central sections 256, 258 that gradually curve inwardly between the first and second side walls 112, 114. The concave central sections 256, 258 form a narrow central portion of the dry eraser 250 that acts as an improved gripping area for the user.

In some embodiments, the bottom wall 106 of the dry eraser 250 can also define a concave central section 260 that gradually transitions from the first and second side walls 112, 114. In some embodiments, the body 102 can be formed from a flexible material such that pressing the dry eraser 250 against a planar surface (e.g., a whiteboard) flexes the body 102 to position the entire bottom wall 106 against the surface (e.g., the concave central section 260 is flexed to define a substantially planar bottom wall 106 until force on the dry eraser 250 is removed).

In some embodiments, one or more walls of the dry eraser 250 can include features 262 (e.g., a textured surface, rubber strips, rubber surfaces, or the like) to further improve the grip of the user on the dry eraser 250. For example, as shown in FIGS. 7 and 8, the dry eraser 250 includes the features 262 along the concave central sections 256, 258 of the front and rear walls 252, 254. However, it should be understood that other portions of the front and rear walls 252, 254, and the first and second side walls 112, 114 can also include one or more of the features 262.

Figure 9:
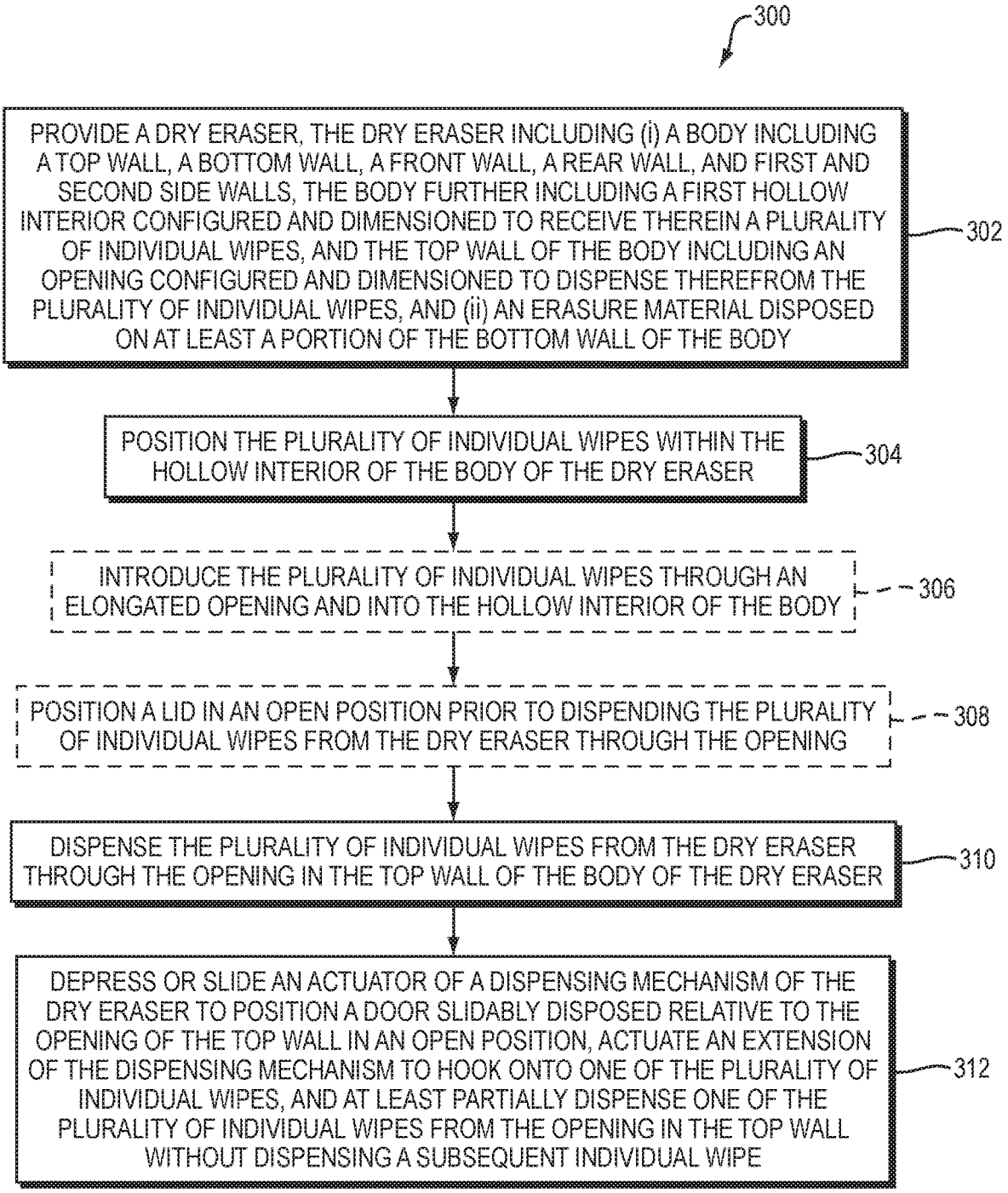
FIG. 9 is a flowchart illustrating a process of implementing an exemplary dry eraser in accordance with embodiments of the present disclosure.

FIG. 9 is a flowchart illustrating an exemplary process 300 of implementing a dry eraser. To begin, at step 302, a dry eraser as described herein is provided. At step 304, the plurality of individual wipes are positioned within the hollow interior of the body of the dry eraser. In some embodiments, at step 306, the plurality of individual wipes can be introduced through an elongated opening and into the hollow interior of the body. In some embodiments, at step 308, a lid can be positioned in an open position prior to dispensing the plurality of individual wipes from the dry eraser through the opening in the top wall.

At step 310, the plurality of individual wipes are dispensed from the dry eraser through the opening in the top wall of the body of the dry eraser. In some embodiments, at step 312, an actuator of a dispensing mechanism can be depressed or slid to position a door slidably disposed relative to the opening of the top wall in an open position, actuate an extension of the dispensing mechanism to hook onto one of the plurality of individual wipes, and at least partially dispense one of the plurality of individual wipes from the opening in the top wall without dispensing a subsequent individual wipe.

Thus, in addition to a non-abrasive erasure material disposed on one side of the dry eraser, the exemplary dry eraser provides an inner chamber for storage of a plurality of wipes for cleaning a whiteboard. In particular, the inner chamber of the dry eraser can receive individual wipes in a variety of ways, and further includes various means for dispensing the wipes from the inner chamber. The dry eraser is structured such that after an individual wipe is dispensed, the opening in the top wall can be covered to prevent drying of the cleaning fluid in which the wipes are presoaked. Thus, rather than locating paper towels and a cleaning fluid for cleaning the whiteboard, the user can dispense individual cleaning wipes directly from the dry eraser, simplifying the overall process for the user.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A dry eraser, comprising:

a body including a top wall, a bottom wall, a front concave wall, a rear concave wall, and first and second side walls, the body further including a hollow interior configured and dimensioned to receive therein a plurality of individual wipes, and the top wall of the body including an opening configured and dimensioned to dispense therefrom the plurality of individual wipes;

an erasure material disposed on at least a portion of the bottom wall of the body; and a dispensing mechanism for dispending the plurality of individual wipes through the opening, the dispensing mechanism comprises (i) a door slidably disposed relative to the opening of the top wall and configured to be positioned in a closed position or an open position, the door covering the opening of the top wall in the closed position, and (ii) an actuator configured to be depressed or slid relative to the body to position the door between the closed and open positions, wherein the dispensing mechanism further comprises an extension disposed within the hollow interior and mechanically cooperating with the actuator such that depressing or sliding the actuator positions the door in the open position, actuates the extension to hook onto one of the plurality of individual wipes, and at least partially dispenses one of the plurality of individual wipes from the opening in the top wall without dispensing a subsequent individual wipe, wherein the actuator is spring-loaded such that releasing the depressed or slid actuator repositions the extension within the hollow interior and positions the door in the closed position.

2. The dry eraser of claim 1, wherein the erasure material is felt.

3. The dry eraser of claim 1, comprising a magnetic component mounted to the outside of the body or incorporated within the body.

4. The dry eraser of claim 1, wherein the opening of the top wall of the body is configured and dimensioned to receive therethrough a container including the plurality of individual wipes.

5. The dry eraser of claim 1, wherein the first side wall, the second side wall, the front wall or the rear wall includes an elongated opening extending into the hollow interior of the body, the elongated opening being configured and dimensioned for introduction of the plurality of individual wipes therethrough and into the hollow interior of the body.

6. The dry eraser of claim 5, comprising a latch configured to be positioned in a closed position and an open position, the latch covering the elongated opening in the closed position.

7. The dry eraser of claim 1, comprising a spring-loaded platform disposed on an inner surface of the hollow interior, the spring-loaded platform biasing the plurality of individual wipes in the direction of the opening in the top wall.

8. The dry eraser of claim 1, wherein at least one of the front wall, the rear wall, the first side wall, or the second side wall comprises a transparent window for visualizing a fullness level of the hollow interior with the plurality of individual wipes.

9. The dry eraser of claim 1, wherein at least one of the front wall, the rear wall, the first side wall, or the second side wall comprises a moisture sensor indicating a moisture level of the plurality of individual wipes within the hollow interior.

10. The dry eraser of claim 9, wherein the moisture level is indicated in a color-coded manner, each color indicating a different moisture level.

11. A dry eraser system, comprising:

a plurality of individual wipes; and a dry eraser including:

a body including a top wall, a bottom wall, a front concave wall, a rear concave wall, and first and second side walls, the body further including a hollow interior configured and dimensioned to receive therein the plurality of individual wipes, and the top wall of the body including an opening configured and dimensioned to dispense therefrom the plurality of individual wipes;

an erasure material disposed on at least a portion of the bottom wall of the body; and a dispensing mechanism for dispending the plurality of individual wipes through the opening, the dispensing mechanism comprises (i) a door slidably disposed relative to the opening of the top wall and configured to be positioned in a closed position or an open position, the door covering the opening of the top wall in the closed position, and (ii) an actuator configured to be depressed or slid relative to the body to position the door between the closed and open positions, wherein the dispending mechanism further comprises an extension disposed within the hollow interior and mechanically cooperating with the actuator such that depressing or sliding the actuator positions the door in the open position, actuates the extension to hook onto one of the plurality of individual wipes, and at least partially dispenses one of the plurality of individual wipes from the opening in the top wall without dispensing a subsequent individual wipe, wherein the actuator is spring-loaded such that releasing the depressed or slid actuator repositions the extension within the hollow interior and positions the door in the closed position.

12. A method of dispensing individual wipes, comprising:

providing a dry eraser, the dry eraser including (i) a body including a top wall, a bottom wall, a front concave wall, a rear concave wall, and first and second side walls, the body further including a hollow interior configured and dimensioned to receive therein a plurality of individual wipes, and the top wall of the body including an opening configured and dimensioned to dispense therefrom the plurality of individual wipes, (ii) an erasure material disposed on at least a portion of the bottom wall of the body, and (iii) a dispensing mechanism for dispending the plurality of individual wipes through the opening, the dispensing mechanism comprises a door slidably disposed relative to the opening of the top wall and configured to be positioned in a closed position or an open position, the door covering the opening of the top wall in the closed position, and an actuator configured to be depressed or slid relative to the body to position the door between the closed and open positions, wherein the dispensing mechanism further comprises an extension disposed within the hollow interior and mechanically cooperating with the actuator such that depressing or sliding the actuator positions the door in the open position, actuates the extension to hook onto one of the plurality of individual wipes, and at least partially dispenses one of the plurality of individual wipes from the opening in the top wall without dispensing a subsequent individual wipe;

positioning the plurality of individual wipes within the hollow interior of the body of the dry eraser; and dispensing the plurality of individual wipes from the dry eraser through the opening in the top wall of the body of the dry eraser by depressing or sliding the actuator of the dispensing mechanism of the dry eraser to position the door slidably disposed relative to the opening of the top wall in the open position, actuating the extension of the dispensing mechanism to hook onto one of the plurality of individual wipes, and at least partially dispensing one of the plurality of individual wipes from the opening in the top wall without dispensing a subsequent individual wipe, wherein the actuator is spring-loaded such that releasing the depressed or slid actuator repositions the extension within the hollow interior and positions the door in the closed position.

13. The method of claim 12, wherein the first side wall, the second side wall, the front wall or the rear wall includes an elongated opening extending into the hollow interior of the body, and wherein positioning the plurality of individual wipes within the hollow interior of the body of the dry eraser comprises introducing the plurality of individual wipes through the elongated opening and into the hollow interior of the body.

* * * * *